US008376584B1

(12) United States Patent
Jenko et al.

(10) Patent No.: US 8,376,584 B1
(45) Date of Patent: Feb. 19, 2013

(54) LIGHTING SYSTEM FOR DECORATING TREES

(76) Inventors: Sarah A. Jenko, Indian Wells, CA (US); Barbara C. Grant, Indian Wells, CA (US)

( * ) Notice: Subject to any disclaimer, the term of this patent is extended or adjusted under 35 U.S.C. 154(b) by 309 days.

(21) Appl. No.: 12/730,845

(22) Filed: Mar. 24, 2010

(51) Int. Cl.
*F21S 4/00* (2006.01)

(52) U.S. Cl. ..... 362/249.18; 362/123

(58) Field of Classification Search ..... 362/123, 362/249.16, 249.18, 249.19; 439/505, 541, 439/527, 586, 593
See application file for complete search history.

(56) References Cited

U.S. PATENT DOCUMENTS 4,099,824 A * 7/1978 Schoppelrey ..... 439/505
4,516,193 A * 5/1985 Murphy ..... 362/123
D287,769 S 1/1987 Davis
4,870,547 A * 9/1989 Crucefix ..... 362/123
5,245,519 A 9/1993 Openiano
5,422,801 A 6/1995 Sangalli, Jr.
5,746,504 A 5/1998 Dodson
7,055,981 B2 6/2006 Yao
8,087,796 B2 * 1/2012 Golembiowski ..... 362/123
2008/0291662 A1 11/2008 Barbieri

* cited by examiner

*Primary Examiner* — Alan Cariaso

(57) ABSTRACT

A light system for decorating a tree featuring a flexible elongated band moveable between an attached position wherein the band is folded onto itself and an unattached position; an attachment means for securing the band in the attached position; a plurality of lights radiating outwardly from an outer surface of the band, the light strands each comprise a cord portion and a plurality of lights disposed along the cord portion; a first power plug and a second power plug, both power plugs being disposed on the band, wherein the first power plug functions to engage an electrical outlet or a second power plug of a second light system and the second power plug functions to accept a first power plug of a third light system; and a wire disposed in the band, the wire operatively connects each light strand to the first power plug and to the second power plug.

18 Claims, 4 Drawing Sheets

(In Side View)

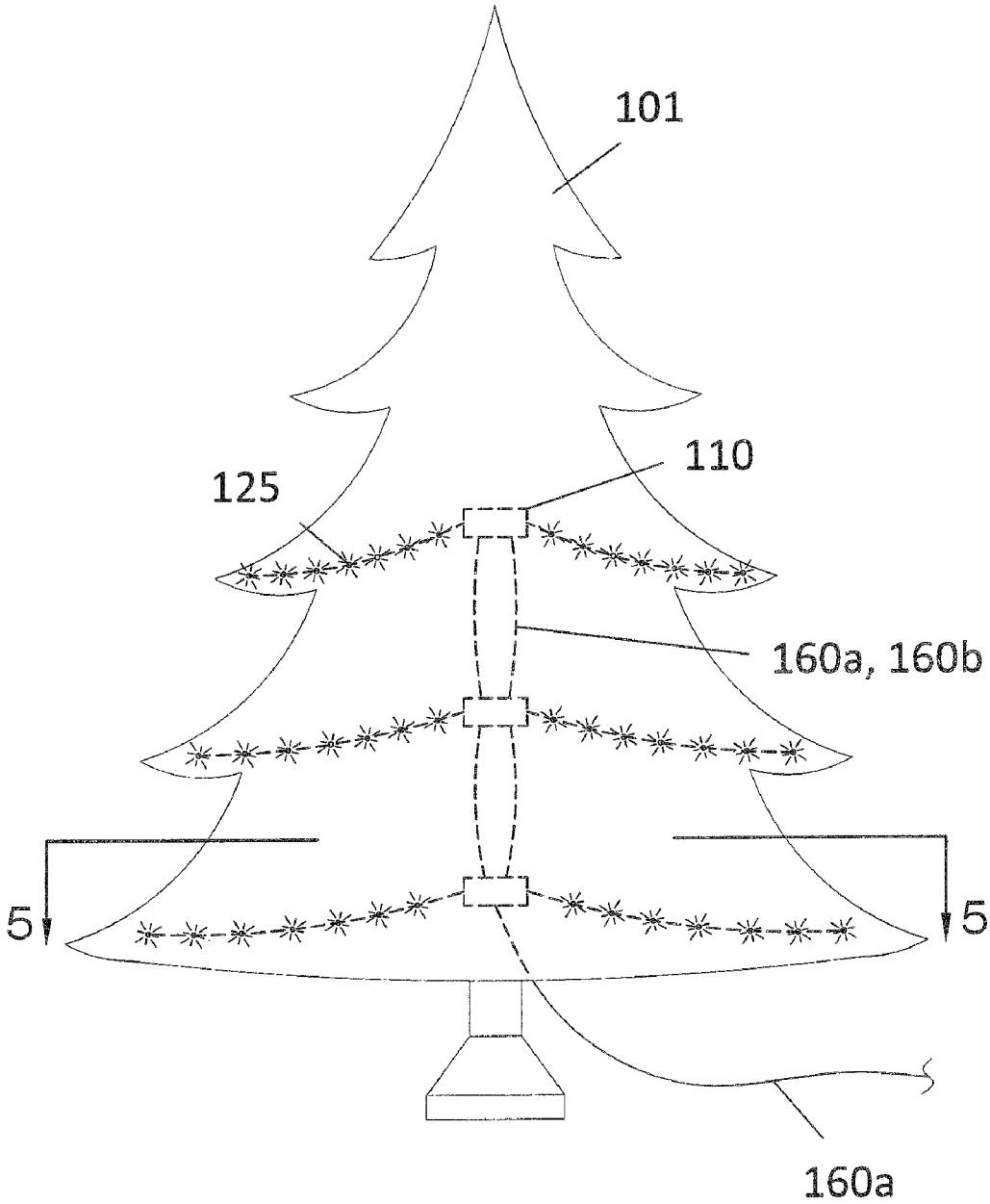
FIG. 4
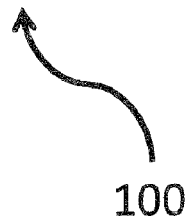

LIGHTING SYSTEM FOR DECORATING TREES

FIELD OF THE INVENTION

The present invention is directed to décor for trees, more particularly to a light system for decorating trees including but not limited to landscaping trees and Christmas trees, or anywhere strings of decorative lights are desired.

BACKGROUND OF THE INVENTION

To decorate trees, for example landscaping trees or Christmas trees, a single strand of lights (or a combination of single strand lights connected together) are lights are typically wrapped around the tree. Winding a strand around a tree in that manner makes it difficult to make sure the lights are distributed evenly. It also makes it difficult to place lights in the centermost part of the tree. Removing the strand of lights can be difficult because the strand of lights can easily become tangled. To replace lights that have burned out, one could add another strand over the existing one, but that can be difficult to do if there are many decorations on the tree. Finding the burned out lights can be time consuming as well.

The present invention features a lighting system for decorating especially trees (e.g., landscaping trees, Christmas trees, etc.). Generally, the system comprises a band that can easily be wrapped around the trunk of the tree. A plurality of light strands extends outwardly from the band. When the band is attached to the tree, the light strands extend outwardly from the trunk of the tree and can be arranged evenly, providing aesthetic appeal. The strands can be laid on the branches of the tree or wrapped around them. In some embodiments, several bands with light strands can be attached to the tree and connected together. The system of the present invention can help eliminate the difficulty of placing and removing lights from trees (and finding burned out lights may be much easier). The system also utilizes a minimal amount of cords, helping to make the tree lighting safer. The system of the present invention also allows for a decorator to decorate the tree creatively with various colors and patterns of lights.

Because the band can be easily removed, a single band with lights can be removed and replaced with a new band with lights (e.g., if wishing to change colors, if needing to replace burned out lights, etc.) without disturbing the already decorated tree.

Without wishing to limit the present invention to any theory or mechanism, it is believed that the system of the present invention is advantageous because it comprises a series of bands that encircle the tree trunk and have varying lengths of light strings that radiate from the band and extend to the tree limb tips. The bands are flexible and can wrap around any size trunk. The bands to not need support posts or clamps. Furthermore, the system 100 of the present invention lights the tree from the trunk radiating outwardly to the limb tips, which can give a more uniform light distribution. This configuration can also be easier to install and remove. The system 100 of the present invention allows the tree to be lit from the interior of the tree along individual branch tips, not just the top to bottom. The bands of the present invention have multiple light strings that are configured into one unit. Any combination of bands can be installed on a tree for optimal lighting. Each band can plug into the band above it and below it (and/or the power source).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 4 is an in-use view of the system of the present invention, wherein three bands are wrapped around the trunk of the tree.

DESCRIPTION OF PREFERRED EMBODIMENTS

Figure 1:
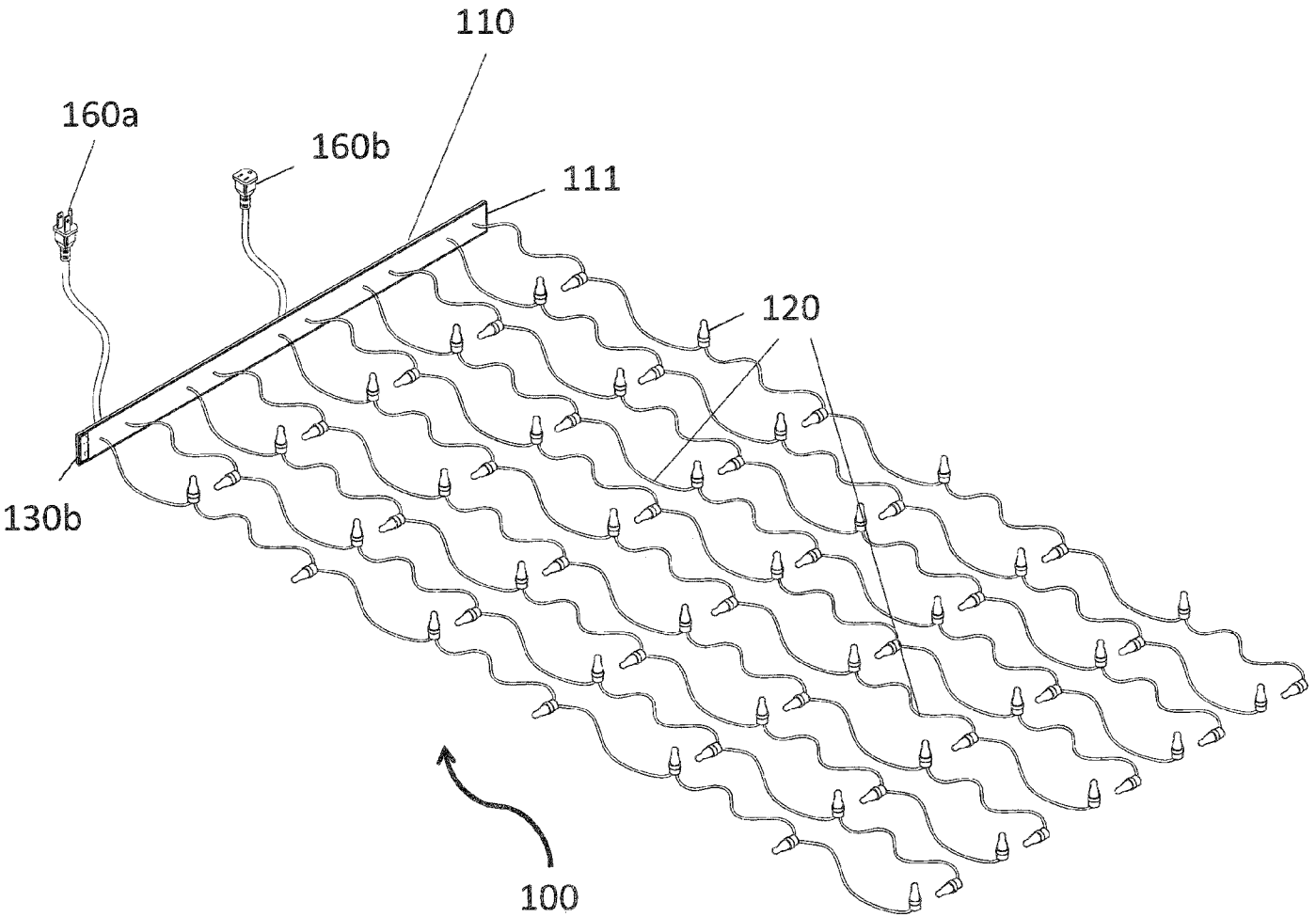
FIG. 1 is a first perspective view of the lighting system of the present invention, wherein the band is in the unattached position.

Referring now to FIGS. 1-5, the present invention features a lighting system 100 for decorating trees including but not limited to landscaping trees and Christmas trees. As shown in FIG. 1, the system 100 comprises an elongated band 110 having a first end 111, a second end 112, an outer surface, and an inner surface. The band 110 is flexible and is adapted to wrap around and encircle a trunk of a tree. The band 110 may be constructed in a variety of sizes to accommodate different sizes of trees, or different sections of a tree (e.g., using a smaller one near the top of the tree and gradually larger ones for thicker sections of the trunk).

The band 110 can move between an attached position (see FIG. 2) wherein the band 110 is folded onto itself (e.g., the first end 111 of the band 110 contacting the second end 112 of the band 110 or a variation thereof) and an unattached position wherein the band 110 is elongated and the first end 111 and second end 112 are free (see FIG. 1).

Figure 2:
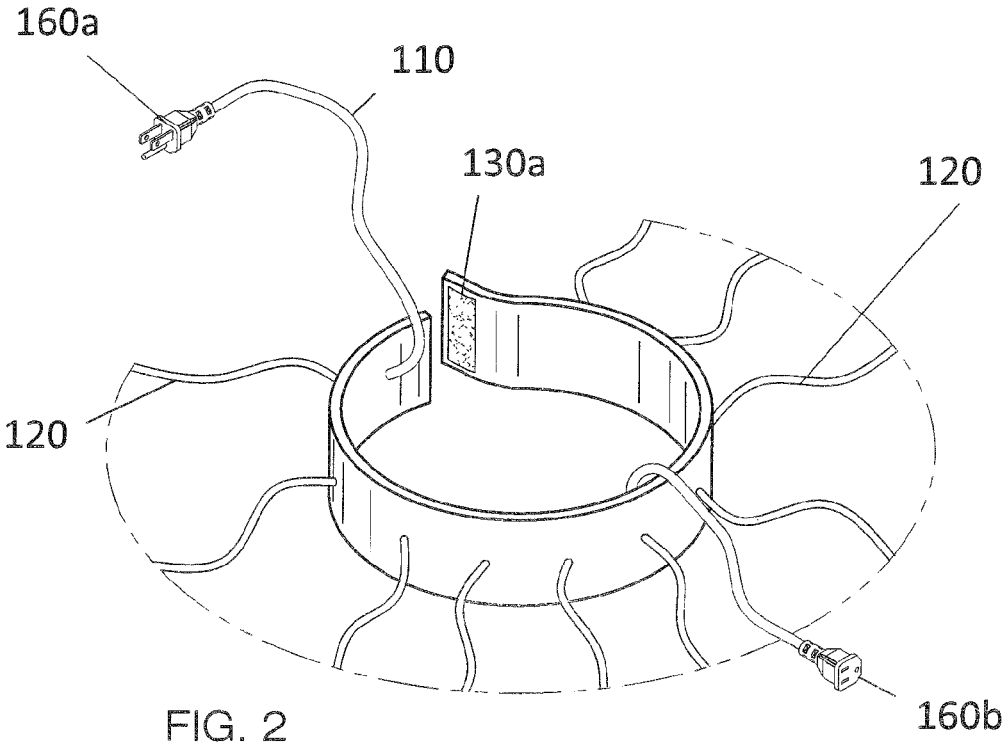
FIG. 2 is a second perspective view of the lighting system of the present invention, wherein the band is in the attached position.
Figure 3:
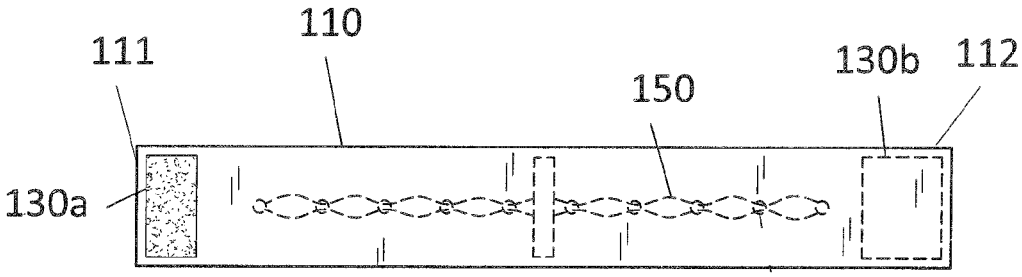
FIG. 3 is a side view of the band of FIG. 1.

The band 110 can be secured in the attached position via an attachment means. For example, a first half attachment means may be disposed on the first end 111 (or near the first end 111) of the band 110, which engages a second half attachment means disposed on the second end 112 of the band 110 (or near the second end 112). The attachment means may include but is not limited to hook-and-loop fasteners, snap mechanisms, button mechanisms, clasp mechanisms, hook mechanisms, clamp mechanisms, cinch mechanisms, tie mechanisms, magnet mechanisms, the like, or a combination thereof. As shown in FIG. 2 and FIG. 3, a first half hook-and-loop fastener **130*a* may be disposed on the first end 111 of the band 110 (e.g., on the inside surface of the band 110), which can engage a second half hook-and-loop fastener 130*b* disposed on the second end 112 of the band 110 (e.g., on the outside surface of the band 110). In some embodiments, the first half hook-and-loop fastener may engage the band 110** itself (e.g., the first half hook-and-loop fastener may be the hook portion of the hook-and-loop fastener).

Radiating (e.g., extending outwardly) from the outer surface of the band 110 is a plurality of light strands 120. The light strands 120 each comprise a cord portion 126 and a plurality of lights 125 positioned along the length of the cord portion 126. Lights and cord portions of light strands are well known to one of ordinary skill in the art and are commonly used for tree décor. In some embodiments, the system 100 comprises at least one light strand, at least two light strands, at least three light strands, at least four light strands, at least five light strands, at least ten light strands, or at least fifteen light strands. The present invention is not limited to the aforementioned number of the light strands.

The light strands 120 are operatively connected to a power source. In some embodiments, an inner wire 150 is disposed in the band 110. The inner wires 150 operatively connect the light strands 120 to a first power plug 160*a* for plugging into an electrical outlet. In some embodiments, the first power plug 160*a* can also be used for operatively connecting the light strands 120 to another power plug (e.g., a second power plug) of a second light system 100. In some embodiments, the inner wires 150 operatively connect the light strands 120 to a second power plug 160*b*, which can accept another power plug of a third light system 110 (e.g., a first power plug of a third light system). Power plugs are well known to one of ordinary skill in the art. For example, power plugs that can be used to plug into an electrical outlet and/or into a different electrical plug are commonly used for standard string lights for Christmas trees.

Figure 5:
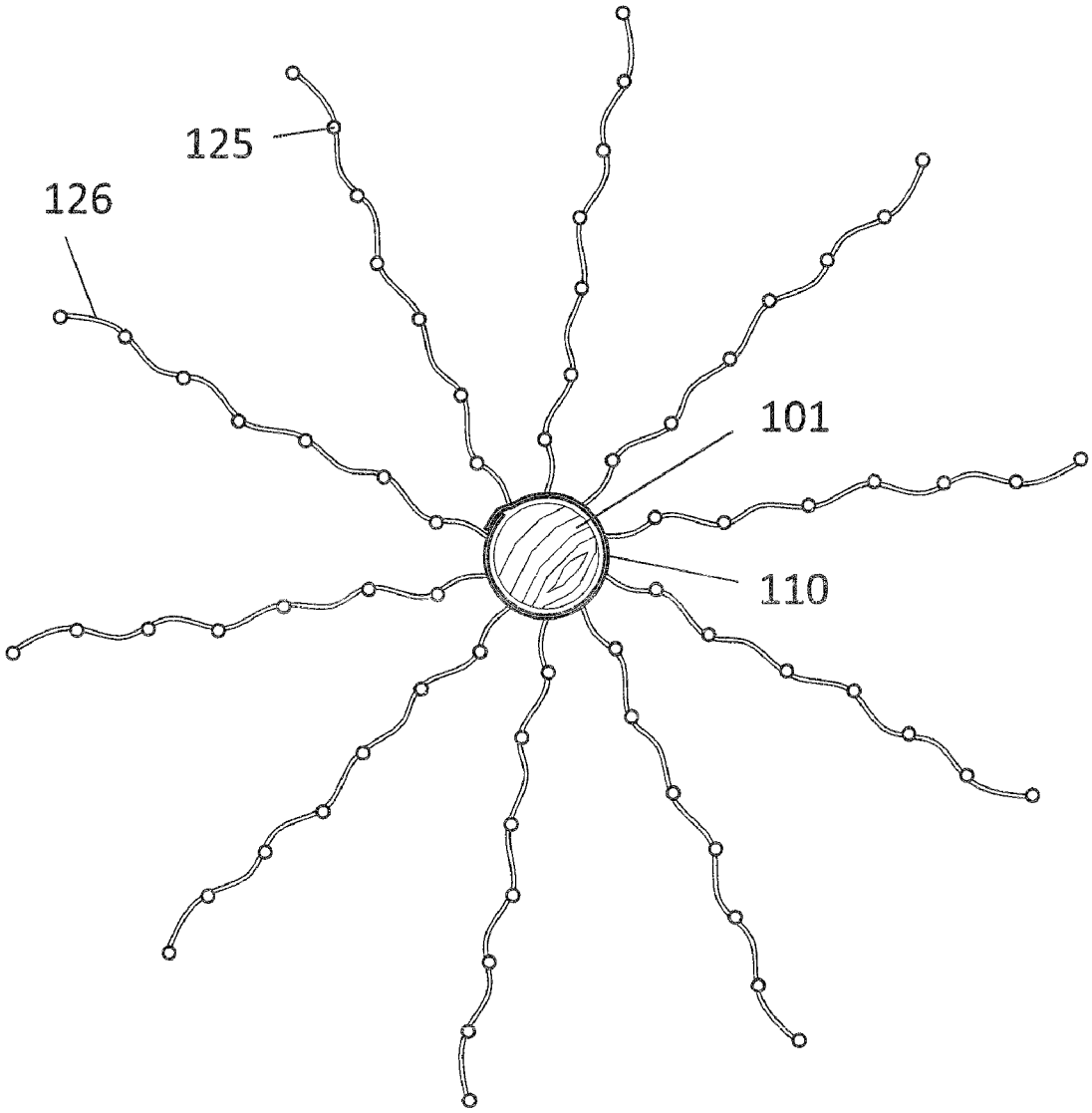
FIG. 5 is a top cross sectional view of the system of FIG. 4 (the tree branches are not shown).

When the band 110 is wrapped around the trunk of the tree 101 (e.g., see FIG. 4), the light strands 120 can be laid on the branches of the tree 101 or wrapped around them. The light strands 120 can be arranged so the light distribution is even, providing aesthetic appeal. As shown in FIG. 4, several light systems 100 can be used on one tree and can be connected via their respective plugs. FIG. 5 shows the system 100 as viewed from above. The band 110 is in the attached position around the trunk of the tree 101, and the light stands 120 radiate outwardly from the band 110.

The present invention also features a kit comprising one or more light systems, for example a first light system. In some embodiments, the kit comprises a second light system. In some embodiments, the kit comprises a third light system and/or a fourth light system and/or a fifth light system and/or a sixth light system, etc. The light systems may be of the same or different colors and can be arranged as the user desires.

The present invention also features a method of decorating a tree. In some embodiments, the method comprises obtaining a first light system, wrapping the band around the trunk of the tree, and securing the band in the attached position via the attachment means. The method further comprises laying the light strands on branches of the tree or wrapping the light strands around branches of the tree; and engaging the first power plug with an electrical outlet to provide power to the first light system and illuminate the light strands.

In some embodiments, the method further comprises obtaining a second light system, wrapping the band of the second light system around the trunk of the tree and securing the band of the second light system in the attached position. The light strands of the second light system can be laid on branches of the tree or wrapped around branches of the tree. The first power plug of the second light system can be engaged with the second power plug of the first light system.

In some embodiments, the method further comprises obtaining a third light system, wrapping the band of the third light system around the trunk of the tree and securing the band of the third light system in the attached position. The light strands of the third light system can be laid on branches or wrapped around branches of the tree. The first power plug of the third light system can be engaged with the second power plug of the second light system.

In some embodiments, the method further comprises obtaining a fourth light system, wrapping the band of the fourth light system around the trunk of the tree, and securing the band of the fourth light system in the attached position. The light strands of the fourth light system can be laid on or wrapped around branches of the tree. The first power plug of the fourth light system can be engaged with the second power plug of the third light system.

The plugs may be of various lengths to ensure they properly connect to each other and/or the power source.

Without wishing to limit the present invention to any theory or mechanism, it is believed that the system 100 of the present invention is advantageous because it comprises a series of bands that encircle the tree trunk and have varying lengths of light strings that radiate from the band and extend to the tree limb tips. The bands are flexible and can wrap around any size trunk. The bands to not need support posts or clamps. Furthermore, the system 100 of the present invention lights the tree from the trunk radiating outwardly to the limb tips, which can give a more uniform light distribution. This configuration can also be easier to install and remove. The system 100 of the present invention allows the tree to be lit from the interior of the tree along individual branch tips, not just the top to bottom. The bands of the present invention have multiple light strings that are configured into one unit. Any combination of bands can be installed on a tree for optimal lighting. Each band can plug into the band above it and below it (and/or the power source).

The following the disclosures of the following U.S. Patents are incorporated in their entirety by reference herein: U.S. Pat. No. 5,746,504; U.S. Pat. Application No. 2008/0291662; U.S. Pat. No. 5,245,519; U.S. Pat. No. 5,422,801; U.S. Pat. No. 7,055,981.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A light system for decorating a tree, said system comprising:

(a) a flexible elongated band having a first end and a second end, the band can move between an attached position wherein the band is folded onto itself and an unattached position wherein the band is elongated and the first end and the second end are free;

(b) an attachment means for securing the band in the attached position;

(c) a plurality of lights radiating outwardly from a plurality of apertures centrally disposed between a top edge and a bottom edge of the band on an exterior facing outer surface of the band, the light strands each comprise a cord portion and a plurality of lights disposed along the cord portion;

(d) a first power plug and a second power plug, both power plugs having wires extending from apertures centrally disposed between a top edge and a bottom edge on an interior facing inner surface of the band, wherein the first power plug functions to engage an electrical outlet or a second power plug of a second light system and the second power plug functions to accept a first power plug of a third light system; and (e) a wire disposed in the band, the wire operatively connects each light strand to the first power plug and to the second power plug.

2. The system of claim 1 comprising at least five light strands.

3. The system of claim 1 comprising at least ten light strands.

4. The system of claim 1 comprising at least fifteen light strands.

5. The system of claim 1, wherein the attachment means includes a hook-and-loop fastener mechanism, a snap mechanism, a button mechanism, a clasp mechanism, a hook mechanism, a clamp mechanism, a cinch mechanism, a tie mechanism, a magnet mechanism, or a combination thereof.

6. The system of claim 1, wherein a first half attachment means is disposed on the first end of the band that engages a second half attachment means disposed on the second end of the band.

7. The system of claim 1, wherein a first half hook-and-loop fastener is disposed on the first end of the band that engages a second half hook-and-loop fastener disposed on the second end of the band.

8. A kit comprising a first light system, a second light system, and a third light system, each light system comprising:

(a) a flexible elongated band having a first end and a second end, the band can move between an attached position wherein the band is folded onto itself and an unattached position wherein the band is elongated and the first end and the second end are free;

(b) an attachment means for securing the band in the attached position;

(c) a plurality of lights radiating outwardly from a plurality of apertures centrally disposed between a top edge and a bottom edge of the band on an exterior facing outer surface of the band, the light strands each comprise a cord portion and a plurality of lights disposed along the cord portion;

(d) a first power plug and a second power plug, both power plugs having wires extending from apertures centrally disposed between a top edge and a bottom edge on an interior facing inner surface of the band, wherein the first power plug functions to engage an electrical outlet or a second power plug of a second light system and the second power plug functions to accept a first power plug of a third light system; and (e) a wire disposed in the band, the wire operatively connects each light strand to the first power plug and to the second power plug.

9. The kit of claim 8 further comprising a fourth light system.

10. The kit of claim 9 further comprising a fifth light system.

11. The kit of claim 10 further comprising a sixth light system.

12. A method of decorating a tree, said method comprising:

(a) obtaining a first light system comprising:

(i) a flexible elongated band having a first end and a second end, the band can move between an attached position wherein the band is folded onto itself and an unattached position wherein the band is elongated and the first end and the second end are free;

(ii) an attachment means for securing the band in the attached position;

(iii) a plurality of lights radiating outwardly from a plurality of apertures centrally disposed between a top edge and a bottom edge of the band on an exterior facing outer surface of the band, the light strands each comprise a cord portion and a plurality of lights disposed along the cord portion;

(iv) a first power plug and a second power plug, both power plugs having wires extending from apertures centrally disposed between a top edge and a bottom edge on an interior facing inner surface of the band, wherein the first power plug functions to engage an electrical outlet or a second power plug of a second light system and the second power plug functions to accept a first power plug of a third light system; and (v) a wire disposed in the band, the wire operatively connects each light strand to the first power plug and to the second power plug;

(b) wrapping the band around a trunk of the tree to encircle the trunk of the tree, and securing the band in the attached position via the attachment means;

(c) laying the light strands on branches of the tree or wrapping the light strands around branches of the tree; and (d) engaging the first power plug with an electrical outlet to provide power to the first light system and illuminate the light strands.

13. The method of claim 12 further comprising obtaining a second light system and wrapping the band of the second light system around the trunk of the tree and securing the band of the second light system in the attached position.

14. The method of claim 13 further comprising laying the light strands of the second light system on branches of the tree or wrapping the light strands around branches of the tree, and engaging the first power plug of the second light system with the second power plug of the first light system.

15. The method of claim 14 further comprising obtaining a third light system and wrapping the band of the third light system around the trunk of the tree and securing the band of the third light system in the attached position.

16. The method of claim 15 further comprising laying the light strands of the third light system on branches of the tree or wrapping the light strands around branches of the tree, and engaging the first power plug of the third light system with the second power plug of the second light system.

17. The method of claim 16 further comprising obtaining a fourth light system and wrapping the band of the fourth light system around the trunk of the tree and securing the band of the fourth light system in the attached position.

18. The method of claim 17 further comprising laying the light strands of the fourth light system on branches of the tree or wrapping the light strands around branches of the tree, and engaging the first power plug of the fourth light system with the second power plug of the third light system.

* * * * *